US007412919B2

(12) United States Patent
Chase

(10) Patent No.: US 7,412,919 B2
(45) Date of Patent: Aug. 19, 2008

(54) HYDRAULIC FORCE CONTROL SYSTEM FOR CLAMPING ASSEMBLY

(75) Inventor: Daniel F. Chase, Longview, WA (US)

(73) Assignee: Loron, Inc., Kelso, WA (US)

( * ) Notice: Subject to any disclaimer, the term of this patent is extended or adjusted under 35 U.S.C. 154(b) by 589 days.

(21) Appl. No.: 11/197,684

(22) Filed: Aug. 3, 2005

(65) Prior Publication Data

US 2006/0073001 A1 Apr. 6, 2006

Related U.S. Application Data

(60) Provisional application No. 60/598,921, filed on Aug. 4, 2004.

(51) Int. Cl.
*F15B 11/028* (2006.01)
*F15B 11/16* (2006.01)

(52) U.S. Cl. ..... 91/520; 414/621

(58) Field of Classification Search ..... 60/424, 60/546, 571; 91/520, 524; 414/621
See application file for complete search history.

(56) References Cited

U.S. PATENT DOCUMENTS 3,990,594 A * 11/1976 Olson et al. ..... 91/520
4,201,510 A * 5/1980 Muntjanoff ..... 91/518
4,431,365 A * 2/1984 Sturtz, Jr. ..... 91/520
6,027,302 A * 2/2000 Nilsson ..... 414/621
6,390,751 B2 5/2002 Jordan et al.
6,431,816 B1 8/2002 Jordan et al.
6,439,826 B1 8/2002 Jordan et al.
6,454,511 B1 9/2002 Jordan et al.

OTHER PUBLICATIONS

Cascade Corporation, "AFC—Carton Clamp," 4 pp. (2000).

* cited by examiner

*Primary Examiner*—Michael Leslie
(74) *Attorney, Agent, or Firm*—Klarquist Sparkman, LLP

(57) ABSTRACT

A hydraulic force control system is disclosed for controlling the clamping force applied to a load by the clamp arms of a clamping attachment of a load-lifting vehicle to prevent the arms from over- or under-clamping the load. The system includes a force control circuit interposed between the vehicle's conventional hydraulic circuit and clamp cylinders of the attachment that operate the arms. When a manual control valve in the conventional circuit is moved to operate the clamp arms, a load sense cylinder in the control circuit lifts a load carriage of the attachment, causing the pressure side of the sense cylinder to sense the weight on the load carriage. Carriage movement actuates a sequence valve in the control circuit to hydraulically connect the pressure sides of said sense and clamp cylinders so that clamping force applied to a load by the clamp arms is proportionate to the weight of the load.

8 Claims, 7 Drawing Sheets

HYDRAULIC FORCE CONTROL SYSTEM FOR CLAMPING ASSEMBLY

RELATED APPLICATION DATA

This application claims the benefit of U.S. Provisional Patent Application No. 60/598,921, filed Aug. 4, 2004, the disclosure of which is incorporated herein by reference.

FIELD

The present invention concerns a hydraulic force control method and system for controlling the clamping force exerted by a clamping assembly used, for example, as an attachment for lift trucks. Such clamping attachments are used, for example, on lift trucks for clamp-handling sensitive loads, such as appliances or other products packaged in cartons.

BACKGROUND

Damage to the product or packaging material being handled is often a problem when clamp-handling cartons or appliances. The trend is to reduce the cost of packaging material by reducing its thickness, stiffness or abrasion resistance. Consequently, current product packaging is often not as rugged as it has been in the past.

Also, lift truck drivers will often over-clamp a load, causing product or packaging damage. In existing systems, typically multiple-position relief valves are used by the lift truck driver to select different clamping forces for various loads. These valves are controlled by the lift truck driver and can be used incorrectly, either by over-clamping the load, or under-clamping the load.

Also, if the truck control valve is operated several times consecutively while revving the truck engine, the clamping force realized is higher than the intended clamping force, which may also damage the load or its packaging.

An additional source of problems with current hydraulic clamping systems is the slight internal hydraulic leakage that can occur within such systems. While transporting a load, slight internal hydraulic leakage in the system can reduce clamping pressure. This may result in an unintended dropping of the load, or, in response to load slippage, the driver may over-clamp to stop such slippage. In either case, damage to the load may occur.

Many current hydraulic force control systems for lift truck load clamping attachments use computers, proportional valves, pressure transducers, related devices, and a feedback loop to adjust the clamping force. These systems are typically very complex and expensive, and also may not react fast enough to adjust the clamping force to a desired level under variable conditions.

SUMMARY

The primary objective of the present invention is to provide a hydraulic force control system and method for controlling the clamping force of conventional clamping assemblies, such as clamping attachments for lift trucks. Part of the objective is to provide such a system and method of clamping a load that is simpler, less costly, more reliable and fool-proof, and therefore, less likely to damage the clamped load than prior such systems and methods. Essentially, the system and method of the present invention will automatically adjust clamping pressure hydraulically to the minimum required to handle a particular load. If there is any shock loading from driving over bumps, etc., the clamping force will automatically be adjusted by the system to prevent load slippage. The system is also designed to automatically adjust for any hydraulic system leakage. Also, most loads have a fairly uniform coefficient of friction. The system and method of the present invention adjusts the clamping force proportionately to the load weight, maintaining the correct clamping force relative to the coefficient of friction of the load.

BRIEF DESCRIPTION OF THE DRAWINGS

Referring to the drawings, FIGS. 1-3, 5, 7, and 8 disclose primarily mechanical aspects of the invention.

FIG. 4 is a hydraulic circuit diagram of a hydraulic force control system of the invention.

FIG. 6 is another embodiment of a hydraulic control circuit in accordance with the invention that includes optional hydraulic circuit components not used in the hydraulic circuit of FIG. 4.

DETAILED DESCRIPTION

Mechanical System

Figure 2:
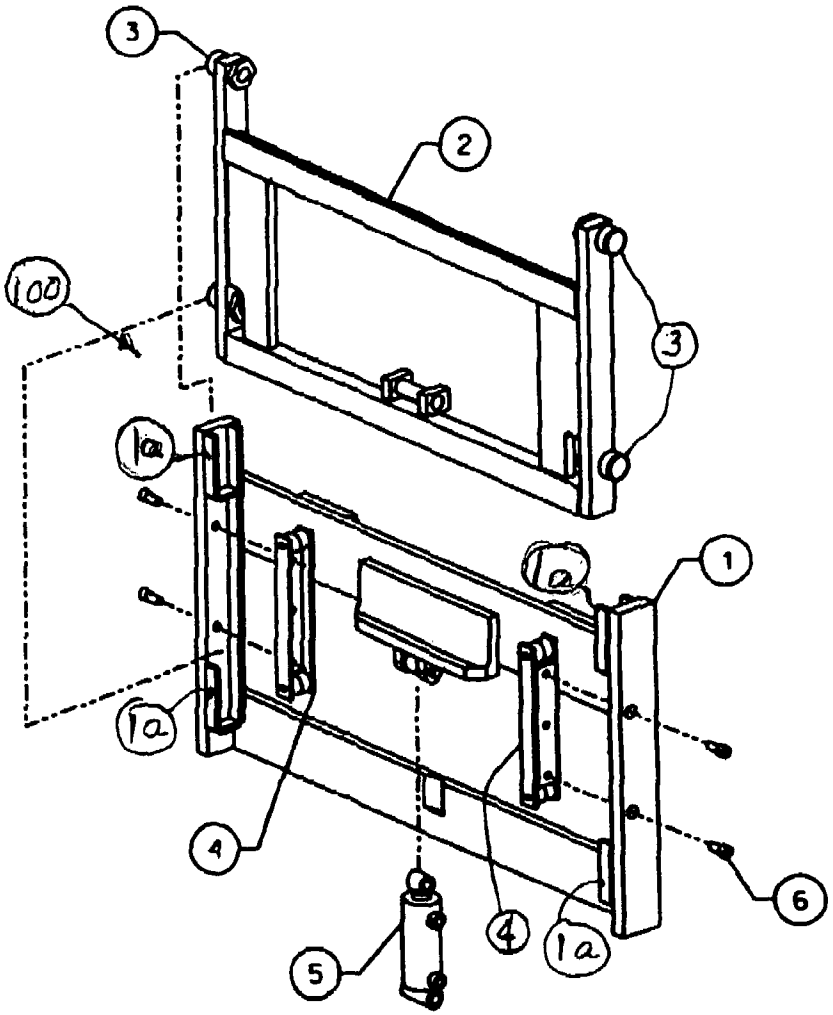
FIG. 2 is an exploded front perspective view of the assembly shown in FIG. 1.
Figure 1:
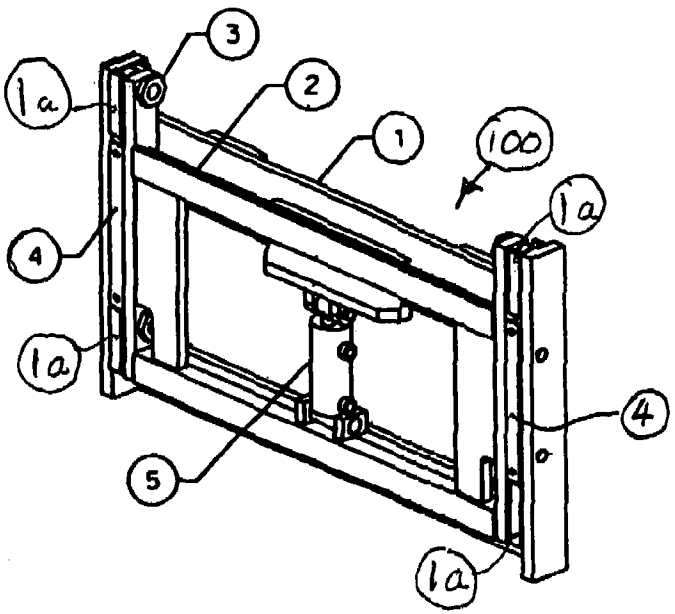
FIG. 1 is a front perspective view of a frame weldment and front carriage assembly that mounts to a standard lift truck carriage and carries a standard lift truck clamping assembly or attachment.
Figure 3:
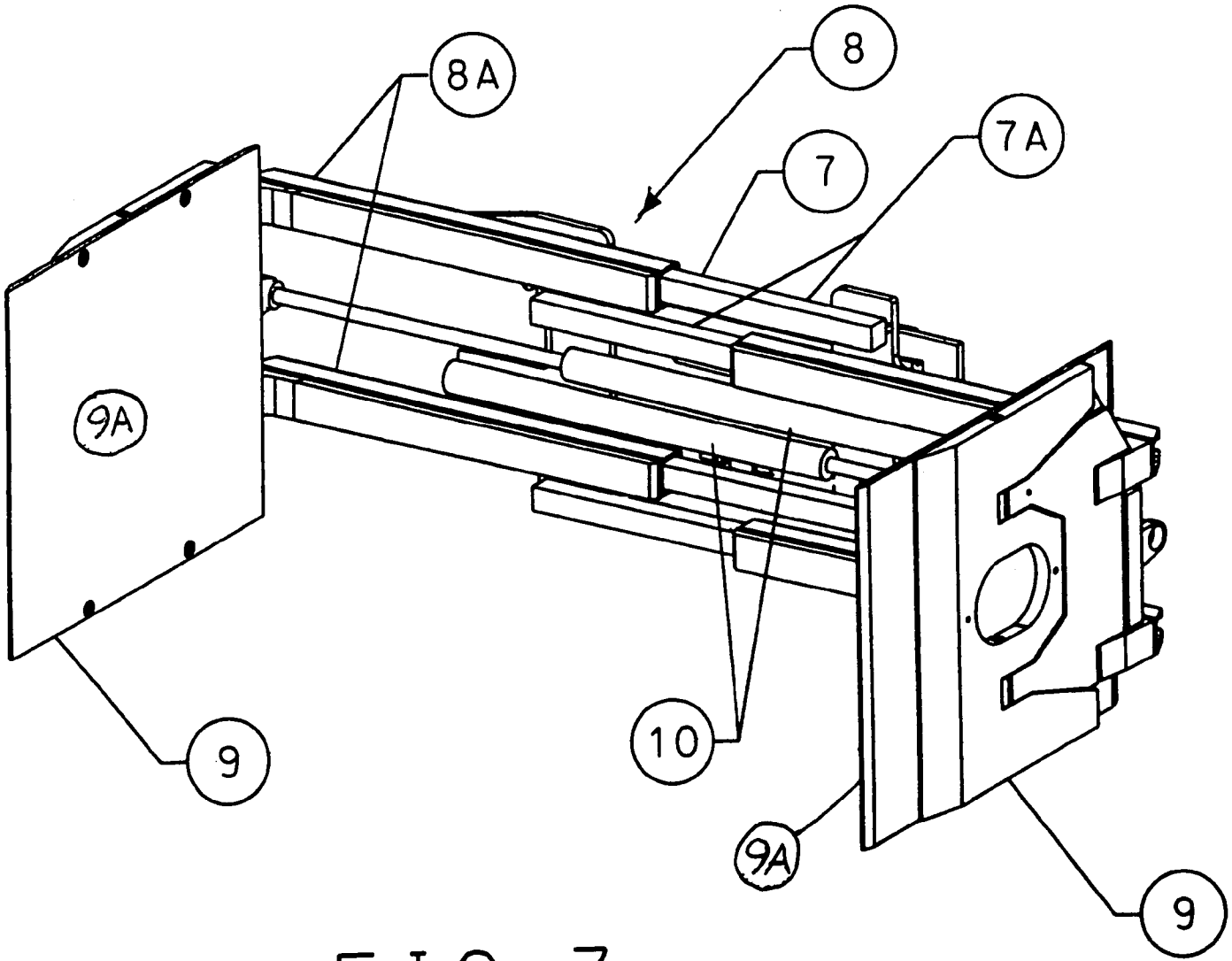
FIG. 3 is a front perspective view of a standard clamping assembly, or attachment, which attaches to the front of the assembly shown in FIGS. 1 and 2.
Figure 7:
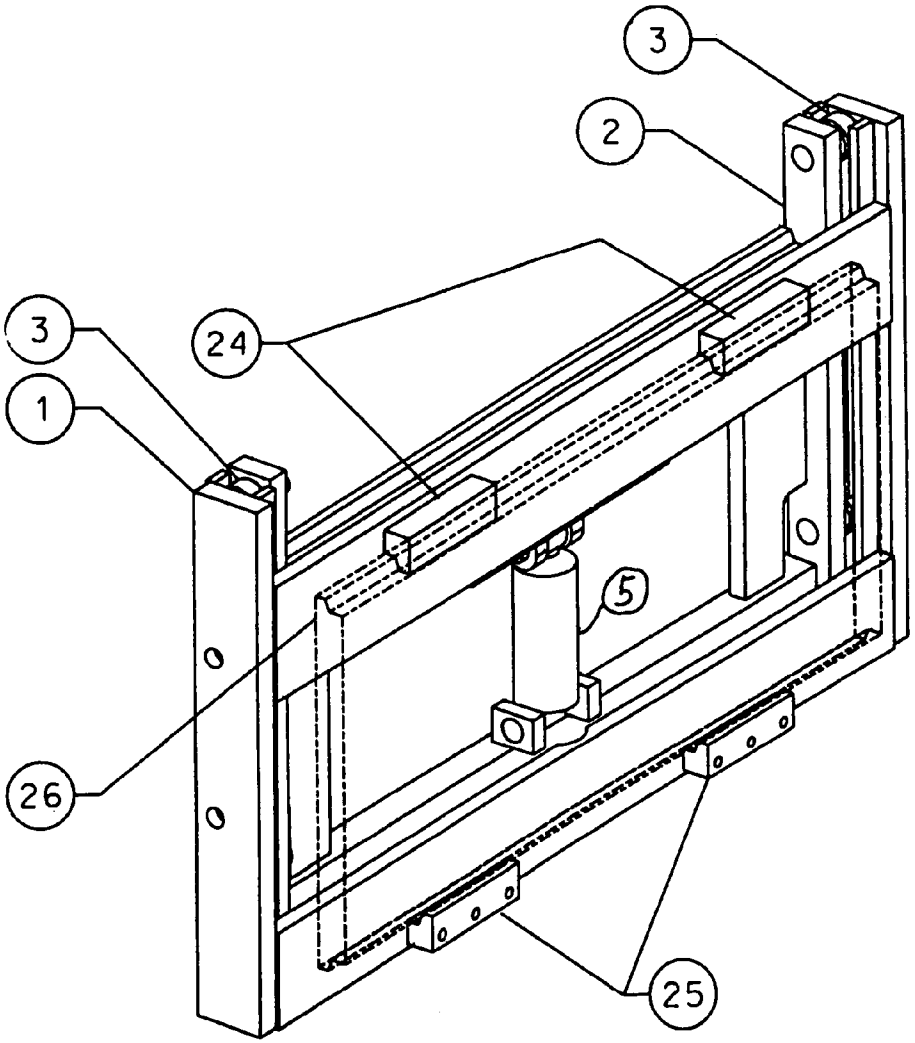
FIG. 7 is an enlarged perspective view of the assembly of FIGS. 1 and 2 attached to a lift truck carriage (shown in dashed lines).

The mechanical assembly 100 shown in FIGS. 1 and 2 is a system that mounts between a standard lift truck carriage 26 and a standard clamping assembly or attachment as shown, for example, in FIGS. 3 and 7.

Referring to FIGS. 1 and 2, a frame weldment 1 mounts directly on the lift truck carriage 26 (see FIG. 7). A front carriage 2 of the assembly fits into the frame weldment channels 1 a shown and is designed to move vertically approximately two inches. Cam roller bearings 3 on the front carriage 2 are used to minimize friction during movement of the front carriage 2 relative to its frame weldment 1. Side thrust roller assemblies 4 mounted on the frame weldment by bolts 6 guide the carriage 2 and prevent side movement and binding of the carriage in the weldment during its vertical movement relative to the weldment. A load sensing hydraulic cylinder 5 is mounted between the frame weldment 1 and the front carriage 2, such that when the cylinder is pressurized by hydraulic fluid, the front carriage 2 can extend approximately two inches relative to the frame weldment 1.

The frame weldment and front carriage assembly may be mounted to the lift truck carriage 26 via top clamps or hooks 24 and bottom clamps or hooks 25 mounted to the frame weldment 1 in the manner shown in FIG. 7. Top hooks 24 are welded to frame weldment 1 and hang on lift truck carriage 26. Bottom hooks 25 are bolted to frame weldment 1 and lock under lift truck carriage 26.

Figure 8:
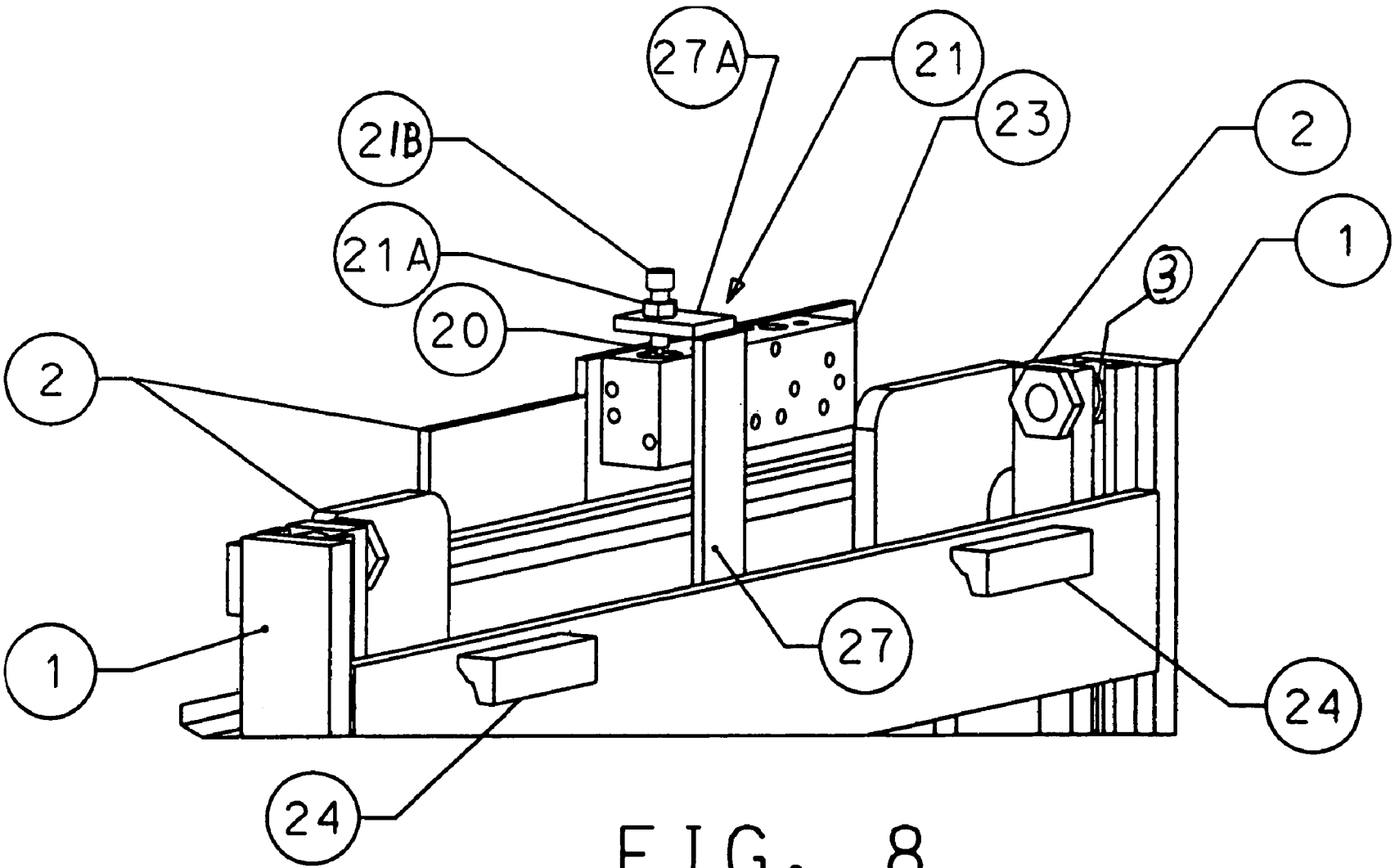
FIG. 8 is an enlarged perspective view of an upper portion of the assembly of FIGS. 1 and 2 showing a valve body that houses most of the valve components of the invention, including the mechanical sequence valve of FIG. 5 that controls operation of the hydraulic force control circuit of the invention.

As shown in FIG. 8, the frame weldment 1 also includes a valve actuating arm 27 attached to a cross-arm of the weldment and extending upwardly therefrom. A mechanical sequencing valve 21 (also see FIG. 5) housed for the most part within a valve body 23 attached to the front carriage 2, includes an adjustment screw 21B and lock nut 21A threaded through a horizontally-extending upper-arm portion 27A of the arm 27. The lower end of the adjustment screw engages a plunger 20 of the mechanical sequence valve 21, and such adjustment screw will depress the plunger to actuate the mechanical sequence valve upon upward movement of the front carriage 2 relative to frame weldment 1. Further description of the function and operation of the mechanical sequence valve will be described with reference to the hydraulic circuit diagrams of FIGS. 4 and 6.

As shown in FIG. 3, a standard carton clamp assembly 8 is attached to and carried by the front carriage portion 2 of the carriage assembly shown in FIG. 1. The clamp assembly includes a frame weldment 7 with horizontal guide bars 7A, that engage slide arms 8A of the clamp assembly. Bearings (not shown) are mounted between the frame weldment 7 and slide arms 8A. Clamp arms 9, equipped with rubber-faced contact pads 9A, are fixed to the slide arms 8A to move with the slide arms toward and away from a load positioned therebetween. The clamp assembly 8 mounts on the front carriage 2 using conventional clamps (not shown). The slide arms 8A are mounted on and move along the horizontal guide bars 7A of the frame weldment 7 upon actuation of clamp hydraulic cylinders 10 mounted on the frame weldment and with their pistons attached to the clamp arms 9.

Figure 4:
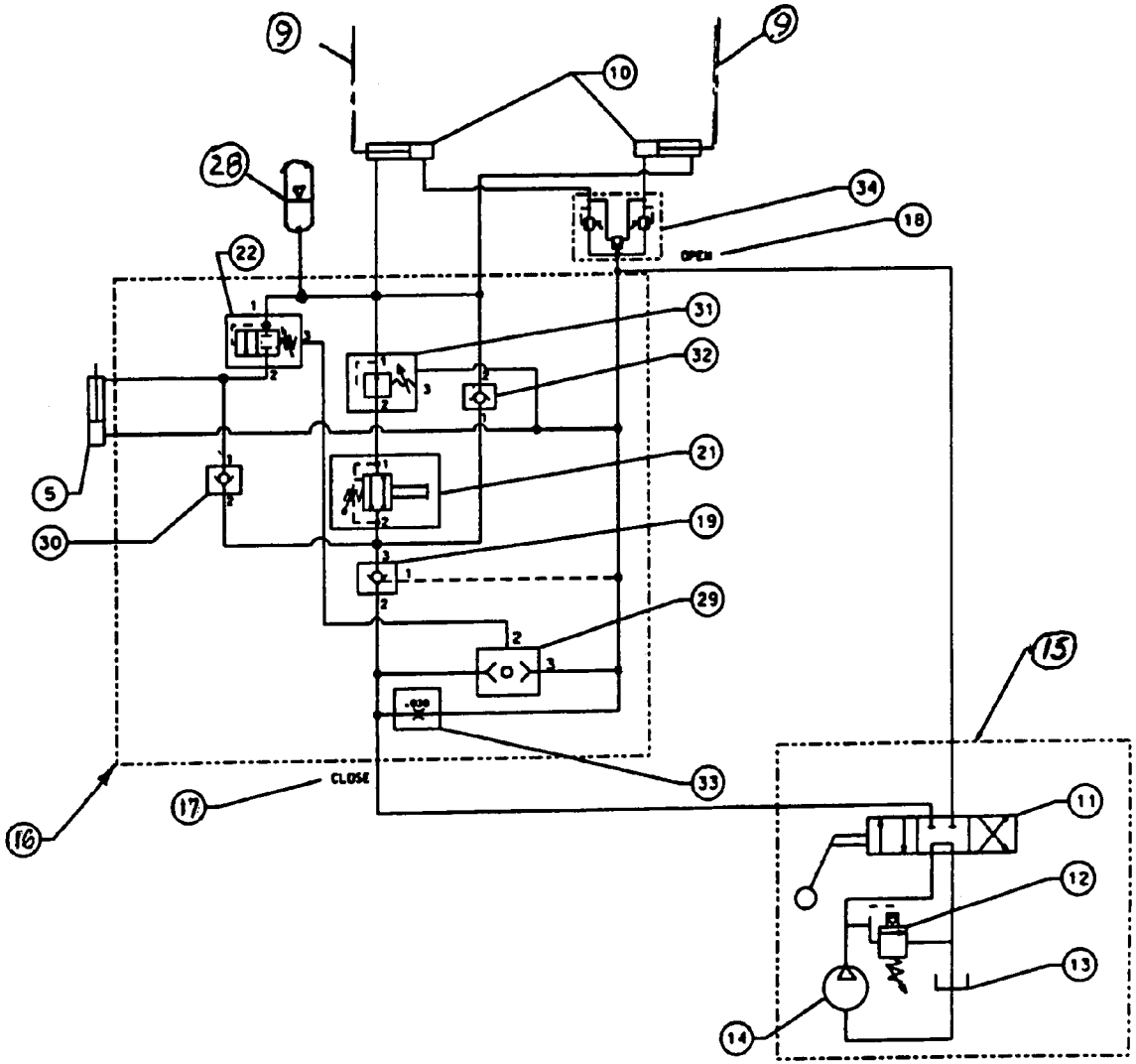
FIGS. 4 and 6 disclose hydraulic circuit diagrams for two embodiments of a hydraulic force control circuit in accordance with the invention.
Figure 5:
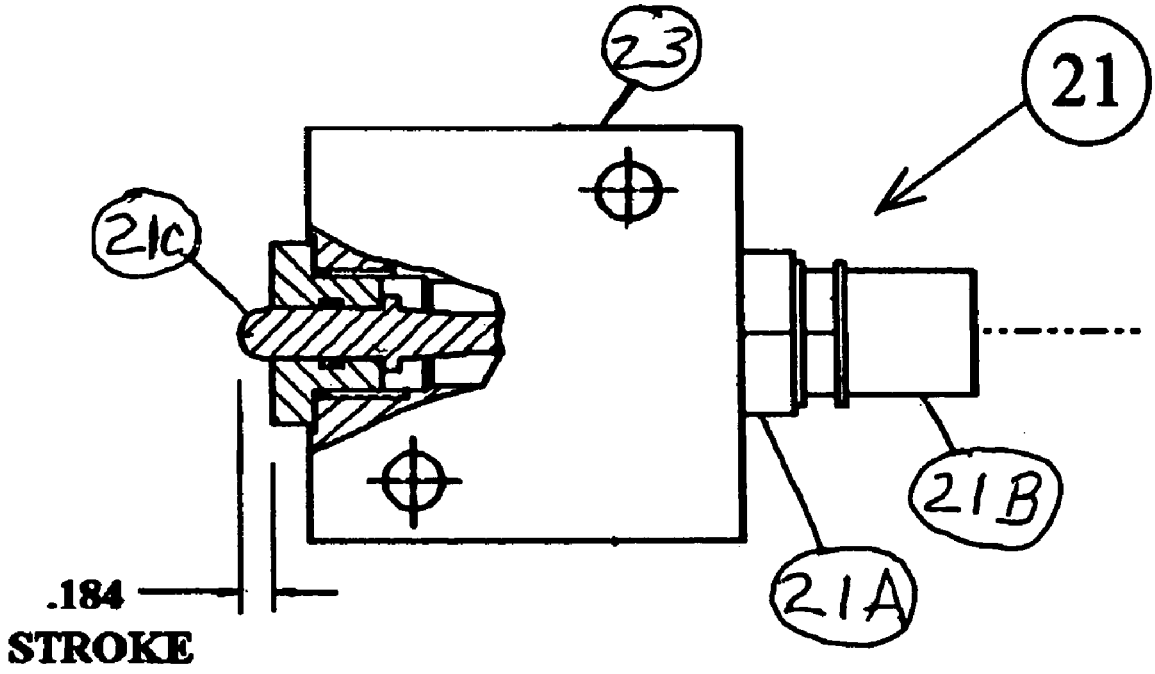
FIG. 5 is an enlarged side elevational view, partially broken away, of the mechanical sequence valve shown in the hydraulic circuit of FIG. 4, and also in the alternative hydraulic circuit of FIG. 6.

Hydraulic Control Circuit of FIG. 4

As shown in FIG. 4, the hydraulic control circuit of the invention shown generally at 16, is hydraulically connected to a lift truck hydraulic system shown generally at 15.

The lift truck hydraulic circuit 15 includes a hydraulic pump 14 that supplies hydraulic fluid to a manually operated control valve 11 and a pressure relief valve 12. In the closed positions of the control valve 11 and relief valve 12 as shown in FIG. 4, hydraulic fluid is pumped from pump 14 through the centered control valve 11 back to the hydraulic reservoir or tank 13.

As further shown in FIG. 4, the hydraulic force control circuit 16 includes both the load sense cylinder 5 and the clamp cylinders 10. In addition, the circuit includes a shuttle valve 29, a pilot check valve 19, two additional check valves 30, 32, a pressure reducing valve 31, a sequence valve 22, the aforementioned mechanical sequence valve 21, an orifice restriction 33, and a flow divider 34.

Operation of Hydraulic Force Control Circuits of FIG. 4

With reference to FIG. 4, the hydraulic force control circuit is operated and functions, as follows:

The control valve 11 of the lift truck hydraulic system is moved by the lift truck operator in the direction that pressurizes the close port 17 and connects the open port 18 to tank 13 of the hydraulic system.

Hydraulic flow is directed through the pilot operated check valve 19 at port 2 of such valve and thereby flows through port 3 of the same valve to port 2 of check valve 30, continuing to the rod side of the load sense cylinder 5. This causes the load sense cylinder to retract because the base end of such cylinder is routed back to tank 13. As a result, the front carriage 2 (FIG. 1) starts to move in an upward direction. At this point, the mechanical sequence valve 21 blocks flow at its port 2 since the front carriage is still in its down position. Flow is also blocked at port 1 of check valve 30 and at port 2 of sequence valve 22. Pressure directed through shuttle valve 29 to port 3 of sequence valve 22 holds the spool of valve 22 in the closed position blocking its port 2. The clamp cylinders 10 cannot close at this point because all flow paths are blocked to the rod side of such cylinders.

When the front carriage 2 rises to a position sufficient to depress the plunger 21C on mechanical sequence valve 21 (also see FIG. 5), port 2 of the mechanical sequence valve 21 opens, allowing flow to pass through the pressure reducing valve 31 to the rod sides of clamp cylinders 10. The base ends of the clamp cylinders are open to tank 13, so fluid is routed through flow divider 34 to tank 13. As a result, the clamp cylinders retract, moving the clamp arms 9 of the clamp attachment in an inward direction. If at this point the control valve 11 is moved to its centered position to stop clamp arm movement prior to the clamp arms clamping on the load, the front carriage 2 will remain in its up position relative to frame weldment 1. The reason for this is that the spring tension on the sequence valve 22 is adjusted so as to keep the sequence valve closed, thereby blocking port 1 of such valve.

If the clamp arms 9 are closed further by repositioning control valve 11 to its original open position, the contact pads 9A of such arms will stop against the load. The pressure reducing valve 31 controls the clamping pressure to a manually preset value. This clamping pressure is sufficient to open port 1 to port 2 of sequence valve 22. When this happens, the rod sides of clamping cylinders 10 are connected to the rod side of the load sense cylinder 5. Thereafter, as the lift truck carriage is raised, the weight of the load on such carriage plus the clamping pressure against the load is carried by the load sense cylinder 5. As a result, pressure at the rod side of the load sense cylinder increases proportionately to the load weight. This increased pressure is transmitted to the rod sides of the clamping cylinders 10, causing the clamping cylinders to close against the load with an increased clamping force proportionate to the load weight. Hydraulic fluid flows out of the base end of clamp cylinders 10 to the base end of the load sense cylinder 5. It is important that the area ratio (rod to base) of the load sense cylinder 5 equal the area ratio of each of the clamp cylinders 10.

Preferably, a fluid pressure accumulator 28 is provided in the control circuit 16 between the load sense cylinder 5 and clamp cylinders 10. More specifically, in the control circuit 16, the accumulator 28 is positioned between sequence valve 22 and clamp cylinders 10.

Accumulator 28 functions to reduce pressure spikes in the control circuit, and specifically at the clamp cylinders. Such pressure spikes may otherwise occur, resulting in overclamping a load, when the clamping assembly is mounted on a vehicle subject to shock loading, such as when a vehicle is driven over, for example, bumps or ruts.

To open the clamp arms 9 of the clamp assembly 8, the manual control valve 11 is moved to a position to pressurize the open port 18 of the hydraulic force control circuit 16. As a result, hydraulic fluid pressure is directed to the base end of the clamp cylinders 10, thereby opening the clamp arms. Hydraulic pressure routed through the shuttle valve 29 to port 3 of sequence valve 22 keeps port 1 of the sequence valve 22 closed. Thus, the flow path is blocked between the rod sides of clamp cylinders 10 and the rod side of load sense cylinder 5. As a result, the front carriage 2 is maintained in its extended position. Pilot pressure on port 1 of the pilot operated check valve 19 permits return flow of hydraulic fluid to tank 13.

Figure 6:
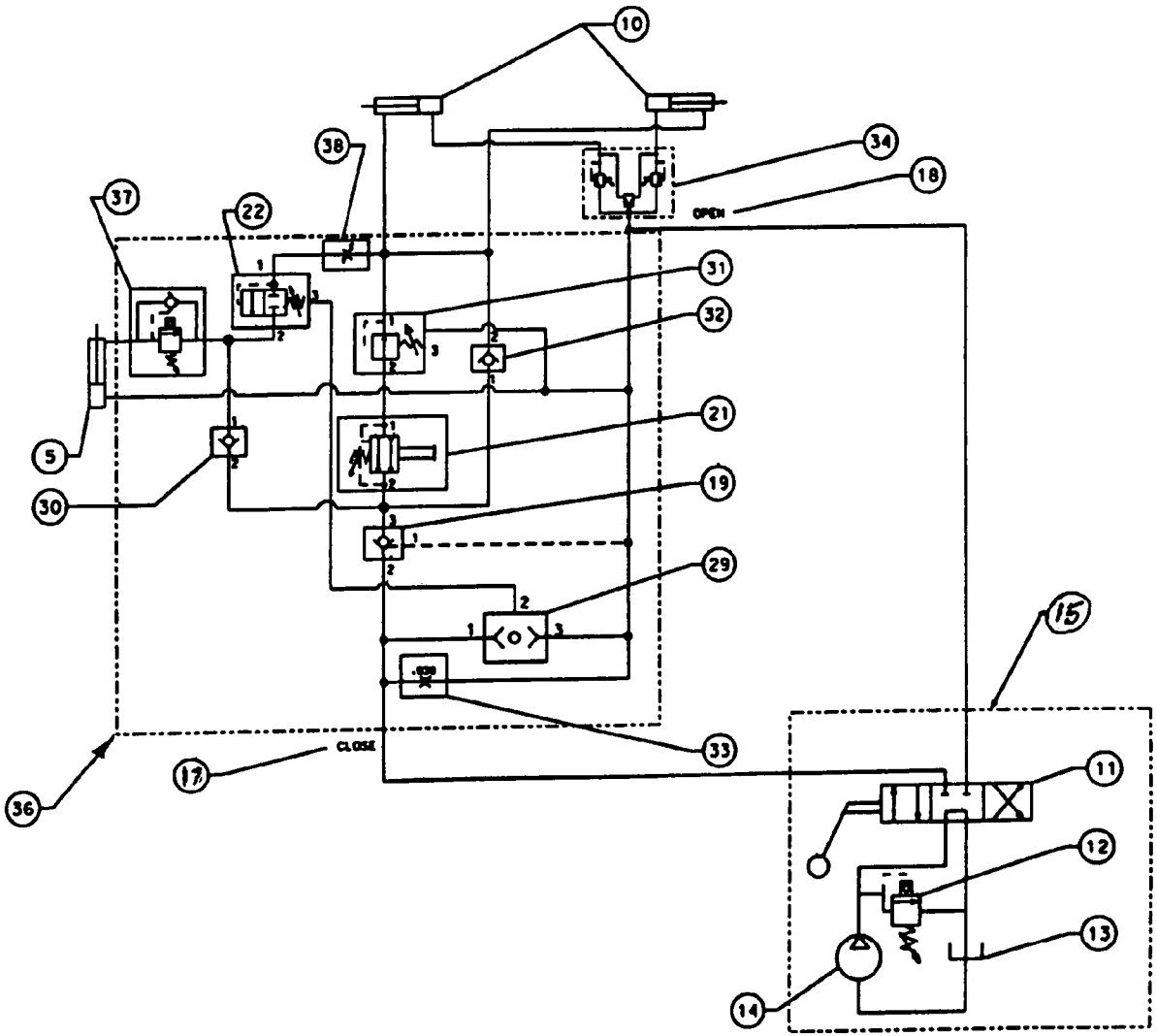

Hydraulic Force Control Circuit of FIG. 6

In addition to the components of the hydraulic force control circuit of FIG. 4, the hydraulic force control circuit of FIG. 6 includes two other components as follows:

The hydraulic force control circuit of FIG. 6 includes an adjustable pressure relief valve 37 with a reverse check. This valve is used to reduce the load-induced clamping force of the clamping arms and is positioned between the load sense cylinder 5 and sequence valve 22.

The hydraulic circuit of FIG. 6 also includes an adjustable restrictor 38 that functions to dampen pressure spikes in the system. This valve is positioned between sequence valve 22 and the clamp cylinder 10. Such pressure spikes might be induced by operation of a lift truck in rough terrain or on rough roadways, etc.

The following table is an example wherein the pressure relief valve 37 is adjusted to reduce the clamping force by 300 lbs.

CLAMP FORCE COMPARISON WITH AND WITHOUT RELIEF (LBS)

| Load Weight (lbs) | Without Relief | Relief adjusted to 300 lbs |
|---|---|---|
| 800 | 1300 | 1000 |
| 1000 | 1450 | 1150 |
| 1200 | 1600 | 1300 |
| 1400 | 1750 | 1450 |
| 1600 | 1850 | 1550 |
| 1800 | 2000 | 1700 |
| 2000 | 2350 | 2050 |

A pressure reducing valve (not shown) could also be used in place of the adjustable pressure relief valve 37. In this case, the pressure reducing valve would be used to limit the maximum clamping force that could be applied against the load.

Although not shown in the drawings, a conventional side shift cylinder could also be included in the attachment to move the load clamping assembly laterally to help align the clamping attachment with the load. This is a common feature of many lift truck clamping attachments, and is well known in the art.

Except as otherwise noted, the hydraulic force control circuit of FIG. 6 operates in the same manner as described with respect to the hydraulic force control circuit of FIG. 4 to control the clamping pressure applied to a load and thereby prevent over-clamping or under-clamping the load.

The foregoing are illustrative of two embodiments of a force control system in accordance with my invention.

Exemplary Parts, Components and Clamping Systems

The force control systems and methods described herein may be adapted for use with various hydraulically operated clamping assemblies, for clamping and transporting loads. For example, typical such clamping assemblies are carton clamps that are lift truck attachments used for lifting and transporting cartons filled with various products. One such carton clamp is manufactured by Loron, Inc., of Longview, Wash., U.S.A. in various sizes to various specifications.

One such model of carton clamp is the Loron L20A with a load capacity of 2000 pounds and made to various size specifications. Another is the Loron L35A with a load capacity of 3500 pounds and also made to various size specifications.

The foregoing carton clamps are intended for use with hydraulic systems having operating pressures in the 2000-2500 psi range and recommended flows of 5-10 gpm.

Hydraulic flow dividers suitable for use in the exemplary control circuits of the present invention include the Models 4F660A, 4F661A, and 4F662A, available from Haldex Hydraulics Corporation of Rockford, Ill.

A suitable shuttle valve is, for example, the Series CSH101B, available from Parker Hannifin's Integrated Hydraulics Division of Lincolnshire, Ill.

Sauer-Danfoss, Inc. (formerly Compact Controls, Inc.) of Hillsboro, Oreg., is a manufacturer of suitable sequence valves, shuttle valves, check valves, motion control valves, relief valves, and pressure reducing valves for the described exemplary hydraulic control circuits. For example, the Sauer-Danfoss Series 10 CP230-2 pressure reducing valve of the direct acting, non-relieving type is suitable for the described hydraulic control circuits.

A suitable motion control valve is the Sauer-Danfoss CP450-1. Suitable check valves include the Sauer-Danfoss CP100-2. A suitable sequence valve includes the Sauer-Danfoss Series 10 CP240-8, which is a sequence valve of the direct-acting spool type.

Suitable relief valves of the direct-acting type for the described hydraulic circuits include the Sauer-Danfoss Series 10 CP200-5.

In summary, the hydraulic force control system of the invention minimizes the clamping force required to handle loads, thereby reducing the likelihood of product damage that may otherwise result from over-clamping the load. Clamping force is automatically adjusted hydraulically, proportionally to load weight. The desired minimal clamping pressure is maintained while transporting the load, and automatically adjusts in the event of shock loading or system pressure loss so as to prevent over-clamping or under-clamping the load.

The foregoing illustrates and describes what are currently two preferred embodiments of hydraulic force control systems in accordance with my invention, and is not intended to limit the scope thereof. I claim as my invention all hydraulic force control systems and methods coming within the true spirit and scope of the following claims.

I claim as my invention, without limitation, the following:

1. A hydraulic force control system for controlling the clamping force applied to a load by a hydraulic cylinder-operated clamping means of a load-clamping attachment of a load-carrying vehicle, the system comprising:

a load carriage assembly adapted for mounting between said load-clamping attachment and a vertically movable support structure of the load-carrying vehicle such that said carriage assembly is movable with the support structure and the attachment;

said load carriage assembly including a carriage frame adapted for mounting to the support structure and a front load carriage mounted on said carriage frame for limited vertical movement relative to said frame, said load carriage assembly being adapted for mounting said load-clamping attachment for movement therewith;

a hydraulic force control circuit adapted for connection to a hydraulic system of the vehicle, including a source of fluid pressure and a manually operated fluid flow control valve;

a hydraulic load sensing cylinder in said control circuit and operatively interconnecting said carriage frame and said front load carriage such that application of hydraulic pressure to said sensing cylinder causes vertical movement of said load carriage to an extended position relative to said carriage frame, and such that, with the load carriage in its extended position, variations in loads applied to the carriage cause a corresponding variation in fluid pressure within the load sensing cylinder;

a normally closed mechanically-operated first sequence valve in said control circuit blocking pressure fluid flow from the fluid pressure source to hydraulic load-clamping cylinder means, said first sequence valve being movable to an open position by said load carriage upon movement of said carriage to its extended position to connect said fluid pressure source to the pressure side of said clamping cylinder means for moving the clamping means into clamping engagement with the load and applying a predetermined minimum clamping pressure to the load; and a normally closed second sequence valve in said control circuit and in a fluid connection between the pressure side of said load sensing cylinder and the pressure side of said clamp cylinder means, said second sequence valve being movable to an open position to fluidly interconnect the pressure sides of said load sensing cylinder and said clamp cylinder means such that variations in pressure within said load sensing cylinder cause corresponding variations in clamping pressure applied by said clamp cylinder means to the load.

2. The system of claim 1 wherein said hydraulic force control circuit includes an adjustable pressure reducing valve between the pressure source and said clamp cylinder means for adjusting the minimum clamping pressure applied to the load by said clamp cylinder means.

3. The system of claim 1 wherein said normally closed second sequence valve returns to its closed position when fluid pressure is applied to the clamp cylinder means in a direction to release the load, such that said load sensing cylinder maintains the front carriage frame in its extended position when the load is released.

4. A hydraulic force control system according to claim 1 wherein said hydraulic force control circuit includes a hydraulic pressure accumulator means operatively positioned in said force control circuit between the pressure side of said load sensing cylinder and the pressure side of said clamp cylinder means and operable to reduce pressure spikes in said force control circuit at said clamp cylinder means during operation of said vehicle.

5. A hydraulic force control system according to claim 2 wherein said hydraulic force control circuit includes a hydraulic pressure accumulator means operatively positioned in said force control circuit between the pressure side of said load sensing cylinder and the pressure side of said clamp cylinder means and operable to reduce pressure spikes in said force control circuit at said clamp cylinder means during operation of said vehicle.

6. A hydraulic force control system according to claim 3 wherein said hydraulic force control circuit includes a hydraulic pressure accumulator means operatively positioned in said force control circuit between the pressure side of said load sensing cylinder and the pressure side of said clamp cylinder means and operable to reduce pressure spikes in said force control circuit at said clamp cylinder means during operation of said vehicle.

7. A hydraulic force control system according to claim 1 wherein said clamping means comprises a pair of opposed load clamping arms and said clamp cylinder means includes a pair of clamp cylinders, one operatively connected to each of said clamping arms.

8. A hydraulic force control system according to claim 4 wherein said accumulator means is operatively positioned in said circuit between said second sequence valve and the pressure side of said clamp cylinder means.

* * * * *